US007213377B1

(12) United States Patent
Sackett

(10) Patent No.: US 7,213,377 B1
(45) Date of Patent: May 8, 2007

(54) DEVICE AND METHOD FOR SPACING AND BRACING FRAMING COMPONENTS

(76) Inventor: Gerald L. Sackett, 2288 Rose Hill Church La., Charlottesville, VA (US) 22902

( * ) Notice: Subject to any disclaimer, the term of this patent is extended or adjusted under 35 U.S.C. 154(b) by 419 days.

(21) Appl. No.: 10/881,835

(22) Filed: Jun. 30, 2004

(51) Int. Cl.
*E04C 3/02* (2006.01)
*E04C 3/30* (2006.01)
*E04H 12/00* (2006.01)

(52) U.S. Cl. ..... 52/696

(58) Field of Classification Search ..... 52/712, 52/714, 715, 696, 745.21, 745.2
See application file for complete search history.

(56) References Cited

U.S. PATENT DOCUMENTS

| | | | | |
|---|---|---|---|---|
| 3,959,945 | A | 6/1976 | Allen | |
| 4,604,845 | A | 8/1986 | Brinker | |
| 5,884,448 | A * | 3/1999 | Pellock | 52/643 |
| 5,899,042 | A | 5/1999 | Pellock | |
| 6,237,300 | B1 * | 5/2001 | Carne et al. | 52/715 |
| 6,244,010 | B1 | 6/2001 | Suliter | |
| 6,332,299 | B1 * | 12/2001 | Stewart, III | 52/696 |
| 6,354,055 | B1 * | 3/2002 | Shaw et al. | 52/712 |
| 6,393,794 | B1 * | 5/2002 | Pellock | 52/696 |
| 6,993,882 | B2 * | 2/2006 | Crawford et al. | 52/696 |
| 2002/0112439 | A1 * | 8/2002 | Rosas | 52/712 |
| 2002/0116891 | A1 * | 8/2002 | Waldrop | 52/632 |

* cited by examiner

*Primary Examiner*—Naoko Slack
*Assistant Examiner*—Hunter Dreidame
(74) *Attorney, Agent, or Firm*—Denis R. O'Brien

(57) ABSTRACT

The present invention is a device and method for simultaneously spacing and bracing adjacent framing components. The disclosed device is an elongate U-shaped spacing member having a pivot tongue extending from one end of the spacing member and a free tongue extending from the other end. The pivot tongue incorporates a pivot plate with a pivotable connection means, and a hinge. The free tongue incorporates an attachment means. Optionally, both or either tongue may incorporate a locking tab. The steps of the disclosed method of the invention include affixing the device to the edge of an incoming framing component; pivotally connecting the pivot tongue to the incoming framing component; positioning the components into their approximate positions relative to one another; lifting the free tongue away from the incoming framing component; rotating the device so that the sides of the spacing member face a fastened component; lowering the free tongue until it contacts the fastened component; finally adjusting the positions of the framing components; engaging the attachment means; tightening the pivotable connection; and, optionally, engaging the locking tabs.

18 Claims, 3 Drawing Sheets

DEVICE AND METHOD FOR SPACING AND BRACING FRAMING COMPONENTS

BACKGROUND OF THE INVENTION

1. Field of the Invention

The invention relates to devices and methods for spacing and bracing framing components during the framing of buildings and other structures.

2. Statement of the Problems Solved by the Invention

Typically, buildings are constructed by initially assembling a frame from a plurality of framing components. The elemental framing components that constitute a building frame are typically elongated pieces of wood or metal. Examples of such basic framing components include studs, rafters, and joists. Other types of framing components include metal or wood "I"-beams and complex components, such as trusses, which are often preassembled from basic wood or metal elements. Once the frame is complete, internal and external sheathing is attached, thereby adding to the strength and rigidity of the structure, as well as providing the flat surfaces that constitute interior and exterior walls, floors, ceilings and roofs.

Design specifications and building codes require inter alia that 1) proper spacing distances must be maintained between adjacent framing components, and 2) the framing components be properly oriented and aligned; i.e., square and plumb. Quality construction requires that these spacing distances and component orientations be accurate and uniform. For instance, in America it is standard for a distance of 16 inches to be maintained between wall studs, and for a distance of 24 inches to be maintained between trusses. (Although the distance between framing components is generally designated as "on-center" distances in plans, specifications, and building codes, unless the context requires otherwise, the term "spacing distance" when used herein refers specifically to the distance between facing sides of adjacent framing components, which is typically the on-center distance minus the thickness of one framing component.)

Having to maintain a consistent spacing distance along the length of framing members creates a problem during construction because it is necessary to measure repeatedly the distance between the components over their entire length. One common solution to this problem is to tack temporary spacers of the proper length between the components and then remove the spacers once the components are tied together permanently. Another technique is to mark the on-center distances on boards and tack those boards to the framing components as they are put into position. Obviously, these spacing tasks slow down the framing process very significantly and easily introduce inaccuracies into the process. They can also subject construction workers to risk of injury. For instance, when working considerable distances off the ground installing trusses, workers have to lean out from the secured truss to measure the correct spacing distance for the incoming truss, thereby increasing the chances of suffering a fall.

A second problem that must be resolved in constructing a frame is that the framing components must often be braced against one another during the construction process. Sometimes this bracing is temporary until the components are fixed or fastened into their final position; sometimes the bracing is permanent. Returning to the example of trusses, when an incoming truss is lifted into place, until it can be braced against a framing component that has already been secured, the incoming truss has a potential for toppling over and injuring workers handling the truss as well as those on the ground. Even if no one is injured, the cost of a damaged truss is significant. Like the spacing problem, this bracing problem is often resolved by tacking temporary braces between the unstable components and the components already secured. Of course, such temporary braces increase construction costs by virtue of the time it takes to nail the braces into position and then remove them, and by virtue of the wasted materials.

Devices and methods that allow adjacent framing components to be spaced and braced quickly, easily, and simultaneously can resolve both of the foregoing problems and, hence, can greatly facilitate the process of building structures while reducing the potential of accidents and material costs.

3. Related Art

A number of solutions to the foregoing problems have been proposed and patented. For instance, two such patents have issued to Pellock—U.S. Pat. No. 5,884,448 and U.S. Pat. No. 5,899,042. These patents disclose elongate truss braces having a U-shaped channel member and end-tongues that extend from the channel member. The U-shaped channel provides stiffness and strength and the end-tongues provide means of attaching the braces to the trusses. In addition, the sides of the channels form side-tabs with integrated nails for further securing the braces to the trusses.

U.S. Pat. No. 6,244,010 issued to Suliter discloses a truss bracing system comprising clips that attach to the trusses and secure the braces thereto. U.S. Pat. No. 4,604,845 issued to Brinker discloses a collapsible spacing device comprised of a plurality of spacer segments attached together end-to-end so that the device can be easily extended and laid across the chords of adjacent framing components to brace them until sheathing is applied to stabilize them. Then the device is removed and folded into its storage configuration.

One of the major disadvantages of the foregoing examples of spacing and bracing devices is that the framers must carry the braces, clips, and other paraphernalia to the point at which they are to be attached to the framing components. For instance, framers installing trusses must carry dozens of braces with them up into the roof area. When incoming trusses are raised into place, the framers must then cast around to find the braces and then attach the braces to the trusses. If such braces are attached to the framing components before the components are placed into position, then the braces stick out from the framing components at right angles and complicate handling and moving the components.

U.S. Pat. No. 3,959,945 to Allen discloses a partial solution to this problem. The truss spacer of Allen comprises an L-shaped spacing member with connecting means at its ends. The spacing member can be attached to prefabricated trusses at the point of manufacture by rotatably securing one end of the L-shaped member to a truss. When the truss is in its final position, the free end of the member is swung out to engage the adjacent truss. While Allen solves the problem of having to store bracing elements at the work site and carry them around, the L-shaped spacing member Allen discloses does not provide sufficient frictional contact with the truss to keep the member from coming loose. When transporting and handling numbers of prefabricated trusses to and around a job site—each truss having a plurality of bracing units attached—obvious problems arise when the units come free and flap around. Also, because Allen discloses only one vertical side wall in his L-shaped member, the device is not self-squaring and obtaining and maintaining the desired 900 angle between the brace and the longitudinal axis of the framing component is problematic. In addition, the single pivot connection of Allen does not provide a very substantial connection between the brace and the framing component.

There would be a significant advantage to spacing and bracing devices combining the U-shaped channel of Pellock with the rotatable connection disclosed by Allen. Judicious choice of the width of the U-shaped channel so that the unit fits snugly onto the edge of the framing component would provide a superior means of frictionally holding the device to the framing component during handling and transport. Consequently, the framers would not have to be bothered with carrying braces around the work area and attaching them to the trusses. If such a U-shaped device could be rotatably attached at one end to the framing component so that other end swings out to connect to the adjacent component, the device could be easily and safely deployed when and where it is needed.

BRIEF SUMMARY OF THE INVENTION

The present invention is a device and a method for simultaneously spacing and bracing a first framing component with respect to a second framing component. The device claimed and disclosed herein comprises an elongate spacing member having a top web with two ends, the top web forming the top of a U-shaped channel. Two side webs depending approximately orthogonally from the top web form the sides of the channel. The distance between the sides of the channel is chosen to permit the spacing member to fit snugly on an edge of the first framing component. In other words, the width of the channel is approximately the thickness of the first framing component so that the channel frictionally accommodates the edge of the framing component. A pivot tongue extends linearly from one end of the top web beyond the side webs. This pivot tongue includes a pivot plate which has a pivotable connection means for pivotally securing the pivot tongue to the first framing component. The pivot tongue also includes a hinge means for facilitating the bending of the top web with respect to the pivot plate. At the opposite end of the device, a free tongue extends linearly from the end of the top web beyond the side web. This free tongue comprises an attachment means for securing the free tongue to the second framing component. The device optionally includes a pivot-end locking tab and/or a free-end locking tab for squaring their respective framing components with the spacing member. When the pivot tongue and free tongue are connected to their respective framing components, the locking tabs are engaged to further secure the device to the framing components and to insure that the framing components are orthogonal to the device and, hence, parallel to one another.

The method of using the device of the invention comprises the steps of affixing the aforementioned spacing and bracing device upon one edge of the first framing component by placing an edge of the first component into the channel formed by the side webs; engaging the pivotable connection means to produce a pivot point between the pivot tongue and the first component; positioning the first and second framing components into their approximate final positions relative to each other; bending the upper web at the hinge means by raising the free tongue away from the edge of the first component until the side webs clear the upper surface of the first component; rotating the device about the pivot point until the side webs point toward the second framing component; lowering the free tongue to the second framing component until it contacts the second framing component; adjusting the final positions of the first and second framing components relative to one another so that their sides are snug against the ends of the spacing member; attaching the free tongue to the second framing component by engaging the attachment means; and, securing the pivot tongue to the first framing component by tightening the pivotable connection. Optionally, if the device includes pivot-end and/or free-end locking tabs, additional steps include securing the locking tabs their respective framing components by engaging the locking tabs, thus squaring the free tongue and pivot tongues to their respective framing components.

BRIEF DESCRIPTION OF THE DRAWINGS

In the drawings identical reference numbers are employed to identify identical elements and primed reference numerals are employed to identify analogous elements. The sizes and relative positions of the elements in the drawings are not necessarily drawn to scale. For example, thicknesses are not drawn to scale and are enlarged to insure comprehension of the drawings.

DETAILED DESCRIPTION OF THE INVENTION

The inventive concepts and novel features of the invention are described herein with reference to specific embodiments, which embodiments represent the best mode known to me for making and using the invention. However, it is to be noted that the embodiments as described herein are not meant to limit the scope of the invention but rather are representative of many possible embodiments that incorporate the inventive concepts of my invention.

1. Structural Features

Figure 1:
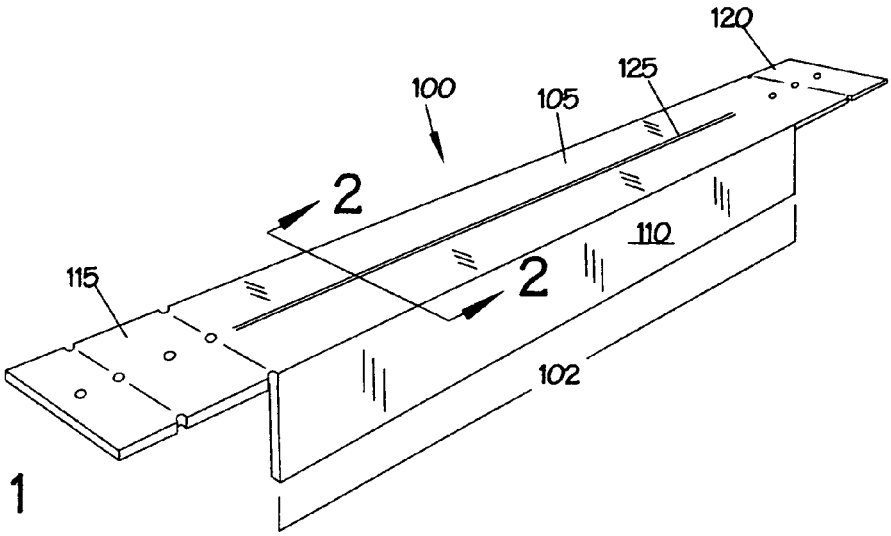
FIG. 1 is a perspective drawing of a preferred embodiment of the spacing and bracing device disclosed herein.
Figure 2:
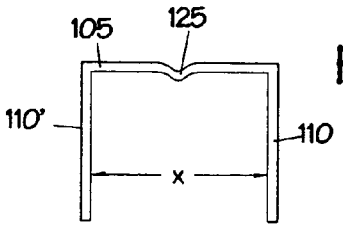
FIG. 2 is a cross-section the spacing member of the spacing and bracing device shown in FIG. 1.

The structural features of the preferred embodiment of a device 100 for spacing and bracing framing components are shown in FIGS. 1–4. The device comprises an elongate spacing member 102 having two ends. The spacing member in cross-section comprises an upper web 105 and two side webs 110 and 110' depending approximately orthogonally from the upper web. Each side web forms an opposing side of a U-shaped channel. The distance between the inner sides of the channel is depicted in FIG. 2 and referred to herein as x, which is also the approximate thickness of the framing component to which the device is pivotally attached, as disclosed below.

At each end of the upper web a tongue extends linearly past the ends of the side webs. For ease of description the ends of the device are referred to herein as the "pivot-end" and the "free-end," and their respective tongues are referred to herein as "pivot tongue" 115 and "free tongue" 120. It should be noted that the figures depict only the essential elements of the two tongues. In practice, the device is manufactured such that the free tongue incorporates all of the elements of the pivot tongue, so that the person installing the device need not waste time distinguishing one end from the other. Up until the point at which one tongue is pivotally connected to a framing component, as disclosed below, the appellations "pivot tongue" and "free tongue" are arbitrary.

Figure 3:
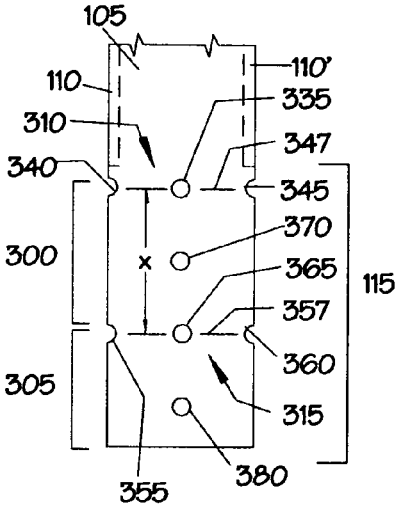
FIG. 3 is a top elevation of the pivot tongue of the spacing and bracing device shown in FIG. 1.
Figure 4:
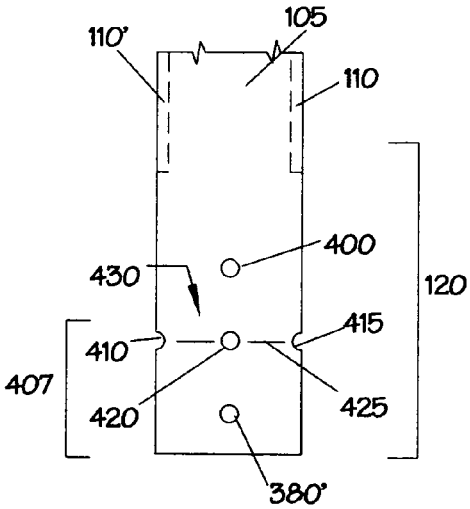
FIG. 4 is a top elevation of the free tongue of the spacing and bracing device shown in FIG. 1.

By referring to FIGS. 3 and 4, the essential structural details of the tongues can be easily appreciated. FIG. 3 illustrates that pivot tongue 115 comprises a pivot plate 300 and, optionally, a pivot-end locking-tab 305. The term "pivot plate" is used herein to mean that part of a tongue that includes a pivotable connection means for pivotally securing the pivot tongue to a framing component. A first hinge 310 for facilitating bending of the top web with respect to the pivot plate separates the pivot plate from the top web. This hinge is formed by a pair of hinge-notches 340, 345, and/or one or more hinge-holes 335, and/or one or more score-lines 347.

Unless the pivot tongue includes an optional locking tab as described below, the terminus of the pivot-plate defines the terminus of the tongue. If the pivot tongue includes a locking tab, the terminus of the pivot plate is a second hinge 315, for facilitating the bending of the pivot-end locking tab with respect to the pivot plate. This second hinge is formed by a pair of hinge-notches 355, 360, and/or one or more hinge-holes 365 and/or one or more score-lines 357. The distance between the two hinges (or between the first hinge and the terminus of the tongue if there is no locking tab), is chosen to be x, the thickness of the framing component.

The pivot connection means of the present embodiment is a pivot hole 370 in combination with a pivot pin, as described below. The pivot hole is provided in the pivot plate such that the center of the pivot hole is approximately mid-way between the edges of the pivot tongue and mid-way between the first and second hinge-lines. The significance of these dimensions and the significance of the placement of the pivot hole will be made evident in the following section.

FIG. 4 illustrates that the free tongue 120, which, like the pivot tongue, is a linear extension of top web 105, comprises an attachment means for securing the free tongue to a framing component. Optionally, the free tongue includes a free-end locking tab 407. The attachment means illustrated in FIG. 4 is an attachment hole 400 in combination with an attachment pin (FIG. 7, 700) wherein the attachment pin passes through the hole and into the framing component as described in the next section.

2. Functional Features

Figure 5:
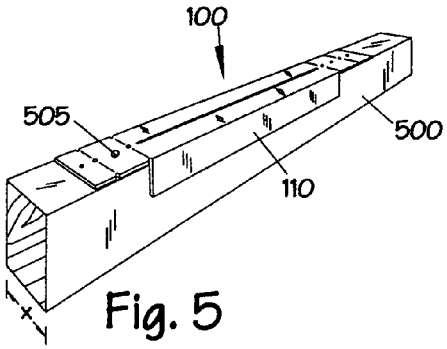
FIG. 5 is a perspective drawing in which the spacing and bracing device shown in FIG. 1 is shown frictionally stored on a framing component.
Figure 6:
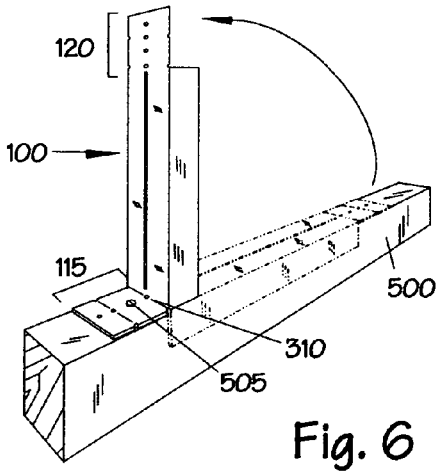
FIG. 6 is a perspective drawing in which the spacing and bracing device shown in FIG. 1 is shown in a raised position during deployment.
Figure 7:
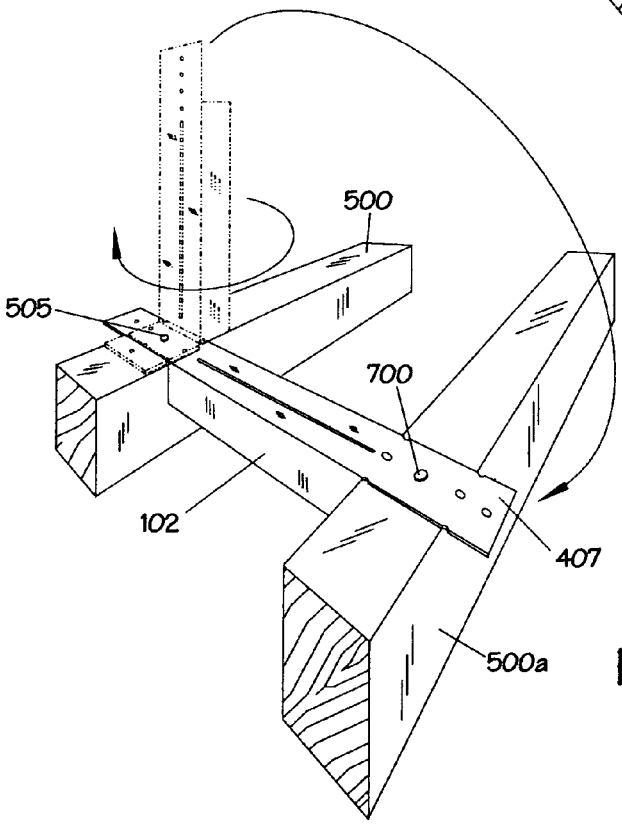
FIG. 7 is a perspective drawing in which the spacing and bracing device shown in FIG. 1 is shown in an extended position and in communication with two adjacent framing components.
Figure 8:
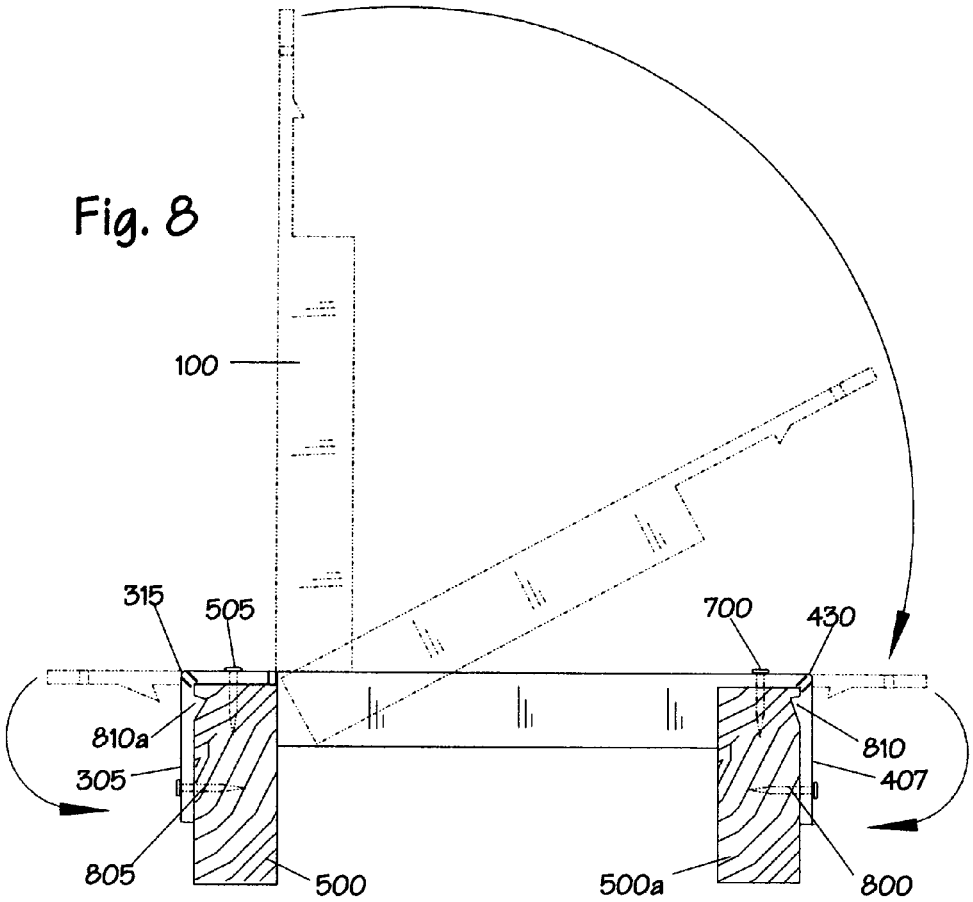
FIG. 8 is a side elevation showing the locking tabs engaged.

The functional features and the preferred method of using the invention may be easily appreciated by referring to FIGS. 5–8. In the example that follows, a first framing component has been placed into position and fastened down. This is referred to herein as the "fastened framing component" or "fastened component." In the interests of clarity, the fastened component is deleted from FIGS. 5 and 6. It is illustrated in FIGS. 7 and 8 as 500*a*. A second framing component 500 is to be brought into position adjacent to the fastened component and secured. This second component is referred to herein as the "incoming framing component" or "incoming component."

FIG. 5 illustrates the manner in which the device 100 is temporarily affixed to the incoming framing component 500 during storage and transport of the component. Because the distance x between the side webs 110 and 110' is approximately equal to the thickness of the incoming component, the spacing member will fit snugly on the edge of the incoming component as shown in FIG. 5.

To more specifically illustrate this self-storing feature of the invention, many framing components are made of wooden boards having a thickness of 1½". Devices according to the invention that are manufactured to be used with such components are made such that the x is approximately 1½". Consequently, when the device is placed on the edge of such a component, frictional forces between the sides of the spacing member channel and the side faces of the component will hold the device in place.

It will be appreciated from viewing FIG. 3 in conjunction with FIG. 5 that when the device is placed snugly on the edge of the framing component, because pivot hole 370 is midway between the edges of the tongue, the pivot hole will automatically be positioned to produce a pivot point at the midline of the component. In other words, the device is self-centering.

As noted above, the tongues are normally produced such that the free tongue incorporates all of the elements of the pivot tongue and, consequently, it makes no difference which end is initially nominated as the pivot-end. A device is simply positioned on the edge of a framing component at the appropriate place along the length of the component, and pivot pin 505 is inserted through pivot hole 370 of one tongue or the other and tacked down, thereby engaging the pivot connection to produce a pivot point between the pivot tongue and the component. In the preferred embodiment, the pivot pin is a nail that penetrates the pivot hole and is driven into the framing component with a hammer. However, it is anticipated that screws, brads, rivets, spikes, and staples may be used as pivot pins with good effect. When the device is used with metal framing components, a screw pivot pin is preferred.

With the device thus secured to the incoming framing component by the frictional forces exerted by the side webs on the component and by the pivot-pin loosely securing the pivot-end, the component can be stored or moved about freely without the device sliding, coming loose, or falling off of the component. For instance, if the component is a preassembled roofing truss and a plurality of the devices are secured to the truss as described above, the truss can be shipped to the building site and lifted up into position without the devices coming loose, dropping to the ground, or getting in the way.

On the job site, once the components are positioned into their approximate final positions relative to each other, free tongue 120 is lifted away from incoming component 500, as shown in FIG. 6. Because pivot-pin 505 holds pivot tongue 115 stationary while the free tongue is lifted, the upper web bends with respect to the pivot plate. This bending is facilitated by first hinge 310. The free tongue is raised until the side-webs clear the upper surface of framing component 500, as shown in FIG. 6.

As shown in FIG. 7, once the side webs are clear of the framing component, the device can be rotated about pivot-pin 505. The device is rotated about the pivot-pin approximately 90° toward the fastened component 500*a* until the side webs face the fastened component, then the free tongue is lowered to the fastened component until the free tongue comes to rest on the upper surface of the fastened component. As noted above, the length of the spacing member (102, FIG. 1) is approximately equal to the desired spacing distance between the components; consequently, proper spacing distance of the components is easily achieved by finally adjusting the components so that their sides are snug against the ends of the spacing member 102. The free-end attachment means is engaged by driving attachment pin 700 through the attachment hole (FIG. 4, 400) of the free tongue and into the fastened component, thereby attaching the free tongue to the fastened component. In the preferred embodiment, the attachment pin is a nail that penetrates the attachment hole and is driven into the framing component with a hammer. However, it is anticipated that screws, brads, rivets, spikes, and staples may be used as attachment pins with good effect. Alternatively, integral nails, as used in nailing plates, may be used. When the device is used with metal framing components, a screw attachment pin is preferred. The pivot connection is tightened by driving pivot pin 505 home hard, thus securing the pivot tongue to the incoming component.

Because the U-shaped channel of the spacing member is stronger than, say, an L-shaped bracing member, the metal can be of significantly thinner gauge and still retain sufficient strength. Reducing the thickness of the metal is advantageous because when sufficiently thin metal is used to make the device, as contemplated by the invention, the device does not obstruct or complicate fastening down of the sheathing; consequently, the device can be left in place permanently and sheathing laid over it. In addition to eliminating the time consuming task of removing the devices, leaving the devices in place contributes to the strength and stiffness of the finished frame. In addition, with the thinner metal troublesome interactions between the devices during handling of the framing components to which the devices have been fitted are minimized.

3. Details, Embellishments, and Variations a. Locking Tabs

Locking tabs may be incorporated into the pivot tongue and/or the free tongue to provide a stronger connection between the device and the framing components. More importantly, the locking tabs draw the components tightly into the ends of their respective spacing members in order to square the components with the spacing member and, hence, insure that the components are parallel to one another. In other words, the device is self-squaring.

As shown in FIG. 3, pivot-end locking tab 305, if included, forms the terminus of the pivot tongue. This locking tab comprises a second hinge formed by a pair of notches 360 and 355, and/or hinge-holes 365, and/or score-lines 357. The distance between the first hinge and the second hinge is x, where x is the thickness of the framing component to which the pivot-end is attached.

Referring to FIGS. 3 and 8, a locking means for securing the pivot-end locking tab to the framing component is provided. The preferred pivot-end locking means is a first fastener perforation 380 (FIG. 3) through which a first locking fastener 800 (FIG. 8) is driven into the fastened component 500*a*. A nail is the preferred locking fastener, but screws, brads, tacks, rivets, spikes, and staples may be used with good effect. An integral nail such as is commonly used in nailing-plates may also be employed. In the case of metal framing components, a screw fastener is preferred.

As shown in FIG. 4, the free-end locking tab 407, if included, forms the terminus of the free-end tongue. This locking tab comprises a third hinge 430 for facilitating the bending of the free-end locking tab with respect to the top web. This hinge is formed by a pair of opposing hinge-notches 410 and 415, and/or hinge-holes 420, and/or score-lines 425. The distance between the third hinge and attachment hole 400 is x/2, where x is the thickness of the framing component to which the pivot-end is attached.

The free-end locking tab is provided with a free-end locking means for securing the free-end locking tab to the framing component. The preferred free-end locking means is a second fastener perforation 380' through which a second locking fastener is driven into the component. A nail is preferred, but screws, brads, tacks, rivets, spikes, and staples may be used with good effect. An integral nail such as is commonly used in nailing plates may also be employed. In the case of metal framing components, a screw fastener is preferred.

Operation of the locking tabs is illustrated in FIG. 8. After the device 100 has been lifted, rotated, and lowered into position as described above, the framing components are snugged against the ends of the spacing member, thereby properly spacing the framing components. At this point the pivot-end locking tab 305 and the free-end locking tab 407 extend beyond the outer edges of the framing components with their hinges, 315 and 430, respectively, positioned approximately over the edges of the framing components. The free-end locking tab is engaged by bending it downwards at its hinge by means of a sharp blow with a hammer, and first locking tab fastener 800 is driven home to secure the free-end locking tab to the fastened framing component and firmly square the spacing member to the fastened component. Pivot-end locking tab 305 is engaged by bending it downwards at its hinge by means of a sharp blow with a hammer, and then second locking tab fastener 805 is driven home to secure the pivot-end locking tab to the incoming framing component and to square the incoming component to the spacing member. Pivot-pin 505 and attachment pin 700 are driven through their respective perforations and into their respective framing components 500 and 500*a* to finally connect the ends of the device to their respective framing components.

The lengths of the locking tabs are not critical, the primary consideration being that the length be sufficient to adequately engage and square the framing component to which they are attached and without extending beyond the bottom edge of the framing component.

b. Hinge Construction

Any of the hinges disclosed herein may be constructed by any means that achieve the objective of facilitating the bending the tongue elements with respect to each other as disclosed above. For instance, a hinge formed of substantially co-linear holes spanning the width of the tongue achieves this objective.

c. Spurs

It will be appreciated that when notches are used to form a locking tab hinge, the notch, acts as a locking means by forming a tooth once the tab is bent. This tooth bites into the edge of the framing component to provide additional frictional holding strength. As shown in FIG. 8, spurs 810 and 810*a* integral to the locking tabs can also be employed as locking means to enhance the strength of the connection between the tabs and their respective components even more.

d. Spacing Member Length Modification Means

Figure 9:
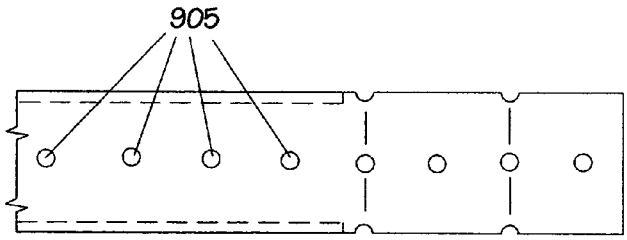
FIG. 9 is a top elevation of the pivot tongue showing spurs and spacing member length modification holes.

A spacing member length modification means is provided to facilitate field modifications in the length of the spacing member and, hence, in the spacing distance between adjacent framing components. An example of such modification means is shown in FIG. 9. Essentially a plurality of co-linear modification holes 905 are incorporated approximately in the centerline of the top web 105 at regular intervals so that the length of the spacing member may be adapted on the job site to accommodate different spacing distance requirements. If such modifications are required, the length of the side webs is reduced by employing tin snips to trim the side webs to the desired length. Markings inscribed on the surface of the device during manufacturing facilitate such field modifications of the devices by showing where the side webs should be shortened to yield a preferred spacing length. Judicious spacing of the modification holes allows the holes to be used either as attachment holes or as hinge-holes. For instance, when working with framing components 1½" thick, modification holes spaced at on-center intervals of ¾" permits one hole to be used as a hinge hole analogous to 420 of FIG. 4, and the two adjacent holes to serve as attachment holes, analogous to 400 and 380' of FIG. 4.

e. Reinforcing Ribs

One or more reinforcing ribs (125, FIG. 1) may be crimped into the upper web and/or the side webs to strengthen the device. One important advantage of such ribs is that they permit a thinner gauge metal to be used in producing the devices. Such ribs crimped into the side webs compensate for a reduction in stiffness of the device when modification holes are included in the top web, as discussed above.

4. Summary

From the foregoing description, the novelty, utility, means of constructing, and means of using my invention will be readily apprehended. However, the foregoing description merely represents the best mode known to me as of the present date. The embodiment herein disclosed is not meant to be exclusive of other ways of making and using my invention, and it will be obvious to those of average skill in the field that other means of producing and/or using the invention lie within the scope of this disclosure and the claims below. It is to be understood that my invention is not limited to the embodiment disclosed above but encompasses any and all embodiments within the scope of the following claims.

I claim:

1. A method of spacing and bracing a first framing component with respect to a second framing component by employing a spacing and bracing device, wherein said spacing and bracing device comprises an elongate spacing member forming a U-shaped channel comprising a top web and two side webs depending approximately orthogonally from said top web such that the width of the channel is approximately equal to the thickness of the first framing component, and wherein the spacing and bracing device further comprises a pivot tongue extending from one end of the top web and a free tongue extending from the other end of said top web, and wherein said pivot tongue comprises a first hinge and a pivotable connection, and wherein said free tongue comprises an attachment means, said method comprising the steps of a. affixing the spacing and bracing device upon the first framing component by placing an edge of the first framing component into the channel;

b. engaging the pivotable connection means to produce a pivot point between the pivot tongue and the first framing component;

c. positioning the first and second framing components into their approximate final positions relative to each other;

d. bending the upper web at the first hinge by raising the free tongue away from the first framing component until the side webs clear the first framing component;

e. rotating the device about the pivot point until the side webs point toward the second framing component;

f. lowering the free tongue to the second framing component;

g. adjusting the final positions of the first and second framing components relative to one another so that their sides are snug against the ends of the spacing member;

h. attaching the free tongue to the second framing component by engaging the attachment means; and, i. securing the pivot tongue to the first framing component by tightening the pivotable connection.

2. A method of spacing and bracing a first framing component with respect to a second framing component by employing a spacing and bracing device, wherein said spacing and bracing device comprises an elongate spacing member forming a U-shaped channel comprising a top web and two side webs depending approximately orthogonally from said top web such that the width of the channel is approximately equal to the thickness of the first framing component, and wherein the spacing and bracing device further comprises a pivot tongue extending from one end of the top web and a free tongue extending from the other end of said top web, and wherein said pivot tongue comprises a first hinge, a pivotable connection, and a pivot-end locking tab, and wherein said free tongue comprises an attachment means, and a free-end locking tab, said method comprising the steps of a. affixing the spacing and bracing device upon the first framing component by placing an edge of the first framing component into the channel;

b. engaging the pivotable connection means to produce a pivot point between the pivot tongue and the first framing component;

c. positioning the first and second framing components into their approximate final positions relative to each other;

d. bending the upper web at the first hinge by raising the free tongue away from the first framing component until the side webs clear the first framing component;

e. rotating the device about the pivot point until the side webs point toward the second framing component;

f. lowering the free tongue to the second framing component;

g. adjusting the final positions of the first and second framing components relative to one another so that their sides are snug against the ends of the spacing member;

h. securing the free-end locking tab to the second framing component by engaging the free-end locking tab;

i. attaching the free tongue to the second framing component by engaging the attachment means;

j. securing the pivot-end locking tab to the first framing component by engaging the pivot-end locking tab; and, k. securing the pivot tongue to the first framing component by tightening the pivotable connection.

3. A device for spacing and bracing a first framing component with respect to a second framing component, said device comprising:

a. an elongate spacing member comprising:

i. a top web forming the top of a U-shaped channel, said top web having a first top web end and an opposing second top web end;

ii. a first side web depending approximately orthogonally from said top web to form one side of said U-shaped channel; and, iii. a second side web depending approximately orthogonally from said top web to form the opposing side of said U-shaped channel;

b. a pivot tongue extending linearly from said first top web end, said pivot tongue comprising a pivot connection means for pivotally connecting said pivot tongue to the first framing component such that said spacing member can be rotated into place between the first framing component and the second framing component after the pivot tongue is pivotally connected to the first framing member by said pivot connection; and, c. a free tongue extending linearly from said second end of said top web beyond said first and second side webs, said free tongue comprising an attachment means for securing said free tongue to the second framing component when said spacing member has been pivoted into position between the first framing member and the second framing member.

4. The spacing and bracing device of claim 3 wherein the distance between said first side web and said second side web is chosen to permit said spacing member to fit snugly on an edge of the first framing component.

5. The spacing and bracing device of claim 3 wherein the length of said spacing member is approximately equal to the desired spacing distance between the first and second framing components.

6. The spacing and bracing device of claim 3 wherein said pivot connection means comprises a pivot hole and a pivot pin.

7. The spacing and bracing device of claim 6 wherein said pivot pin is chosen from the group consisting of nails, screws, brads, rivets, spikes, and staples.

8. The spacing and bracing device of claim 3 wherein said attachment means comprises an attachment hole and an attachment pin.

9. The spacing and bracing device of claim 3 wherein said attachment means comprises at least one integral nail.

10. The spacing and bracing device of claim 3 wherein said pivot tongue further comprises:

a. a pivot-end locking tab means for squaring the first framing component with the spacing member by drawing the first component into the end of the spacing member;

b. a second hinge means for facilitating the bending of said pivot-end locking tab with respect to said pivot plate; and, c. a first locking means for securing said pivot-end locking tab to the first framing component.

11. The spacing and bracing device of claim 10 wherein said first locking means comprises at least one first fastener perforation and at least one first locking fastener.

12. The spacing and bracing device of claim 10 wherein said first locking means comprises at least one spur integral to said pivot-end locking tab.

13. The spacing and bracing device of claim 3 wherein said free tongue further comprises:

a. a free-end locking tab means for squaring the second framing component with the spacing member by drawing the second component into the end of the spacing member;

b. a third hinge means for facilitating the bending of said free-end locking tab with respect to said top web; and, c. a second locking means for securing said free-end locking tab to the second framing component.

14. The spacing and bracing device of claim 13 wherein said second locking means comprises at least one second fastener perforation and at least one second locking fastener.

15. The spacing and bracing device of claim 13 wherein said second locking means comprises at least one spur integral to said free-end locking tab.

16. The spacing and bracing device of claim 3 further comprising a spacing member length modification means for facilitating field modifications in the length of said spacing member.

17. The spacing and bracing device of claim 16 wherein said spacing member length modification means comprises a plurality of co-linear modification holes incorporated approximately in the centerline of said top web.

18. The spacing and bracing device of claim 17 wherein the distance between said co-linear modification holes is chosen to allow the holes to be used either as attachment holes or as hinge-holes.

* * * * *